United States Patent [19]

Schreiber

[11] Patent Number: 4,503,429

[45] Date of Patent: Mar. 5, 1985

[54] COMPUTER GRAPHICS GENERATOR

[75] Inventor: Paul T. Schreiber, Fort Worth, Tex.

[73] Assignee: Tandy Corporation, Fort Worth, Tex.

[21] Appl. No.: 339,478

[22] Filed: Jan. 15, 1982

[51] Int. Cl.[3] ..... G09G 1/02

[52] U.S. Cl. ..... 340/799; 340/747

[58] Field of Search ..... 340/798, 799

[56] References Cited

U.S. PATENT DOCUMENTS

| | | | |
|---|---|---|---|
| 4,383,296 | 5/1983 | Sander | 340/799 X |
| 4,386,773 | 6/1983 | Bronstein | 340/799 X |
| 4,418,343 | 11/1983 | Ryan et al. | 340/799 X |

*Primary Examiner*—David L. Trafton

*Attorney, Agent, or Firm*—Wolf, Greenfield & Sacks

[57] ABSTRACT

Electronic circuitry for generation of graphics images on a computer display screen is disclosed which allows graphics capability to be added or retrofitted to computers having standard video display character generation circuitry. The graphics circuitry receives address, data and control signals from the normal computer peripheral bus. Address signals received by the graphics circuitry are interpreted as command signals and, in accordance with the command signals, data present on the computer peripheral data bus is interpreted either as graphics data to be written in a random access graphics memory or as an address location for such data in the memory. The graphics circuitry normally operates asynchronously with respect to the computer under control of the character clock generated by the character generation circuitry. Proper synchronization with computer operation is achieved by using wait commands which cause the computer circuitry to cease processing temporarily while write or read operations are being processed by the graphics circuitry. In addition, special circuitry is provided which allows the graphics circuitry to automatically increment and decrement address information stored within the circuitry.

23 Claims, 10 Drawing Figures

TO VDG SOCKET
FROM VDG SOCKET
406
405
415
VDG
410
ADDRESS TRANSLATOR
420
INPUT DATA REGISTER
445
446
MUX
450
451
DATA IN
GRAPHICS RAM
ADDRESS
DATA OUT
485
486
LINE REGISTER
460
465
441
440
INTERNAL DATA BUS
480
OUTPUT DATA REGISTER
481
482
MEMORY CONTROLLER
470
472
473
471
438
437
436
BUFFER
430
COMMAND DECODER
435
439
CHARACTER ROM
490
491
492
487
488
489
TO ROM SOCKET
FROM ROM SOCKET
493
CONTROL
402
DATA
401
ADDRESS
400
COMPUTER

MEMORY CONTROLLER 977
985
970
979
968
969
955
965
960
966
967
910
905
915
900
920
950
988
987
997
990
998
CAS*
RAS*
WR*
AO-A6
DO DI
IVDD7
IVDDO
OVIDD7
OVIDDO
VIDRAMRD*
RDLATCH*
FROM INPUT DATA REGISTER
TO INTERNAL DATA BUS
INTERNAL DATA BUS
FROM CHARACTER ROM SOCKET 999
TO CHARACTER ROM SOCKET
CHARACTER ROM
VROMDO
VROMD1
VROMD2
VROMD3
VROMD4
VROMD5
VROMD6
VROMD7
RAS* GRAPHIC/ ALPHA*
YREGD7
XY/CRTC*
YROMD7
XROMD6
YROMD6
XREGD6
YREGD6
XROMDO
YROMDO
XREGDO
YREGDO
MUX
XY/CRTC*

COMPUTER GRAPHICS GENERATOR

FIELD OF THE INVENTION

This invention relates to circuitry for the generation of visual display information under computer control and, more particularly, to the generation of graphics information for computer displays.

BACKGROUND OF THE INVENTION

Many modern computer systems utilize one or more cathode-ray tube terminals which are able to display the results of computations and other information under computer control. Accordingly, circuitry is normally provided either in the terminal or in the associated computer to generate, in response to digital signals generated by the computer, the appropriate television signals required to produce alpha/numeric characters on the CRT screen. This circuitry is generally capable of providing a standard, fixed set of characters, including letters, numbers and a selected set of standard symbols, such as punctuation marks.

Often, however, it is desired to display information which cannot be conveyed with the standard alpha and numeric character set. Such information is usually termed "graphics" information and may consist of dots, bars or lines and may be useful in drawing graphs, nonstandard characters, and maps or in video games. In addition, various portions on the screen may be illuminated in different colors. In order to display graphics information it is necessary to be able to generate video information in a small area at any location on the CRT screen specified by the computer.

Most computer systems with graphics capability contain what is known as a "memory-mapped" graphics system. In this type of system, a large graphics random access memory is provided in which each display position on the video screen corresponds directly to a particular address in memory. Accordingly, the computer displays information on the CRT screen by simply writing digital information into one or more addresses to display spots at corresponding locations on the screen.

Memory-mapped systems operate satisfactorily if they are built into the original computer system when it is fabricated. However, in many present day operations, the user of a computer system initially wishes to buy a small, basic system and then expand the capabilities of the system as the user's needs expand. Typically, the basic system includes at least one video terminal with alpha and numeric character generation circuitry but does not include graphics circuitry.

With a small system of this type it has been found that it is extremely difficult to add memory-mapped graphics circuitry on to the pre-existing computer circuitry without physically and electrically disassembling the computer and placing many jumpers on internal data lines. The time and expense required to physically rewire the unit often makes the addition of graphics capabilities of such basic computers impractical.

In addition, memory-mapped arrangements have other problems. For example, they inherently require a large number of components. Further the electrical address of each graphics memory location does not correspond directly with the physical X and Y coordinates of the display locations on the video screen. Therefore, additional software programs must be included to translate between physical X and Y addresses which are of interest to the computer user and actual internal memory addresses. Another problem is that the memory-mapped arrangement is always active in that it must respond to access attempts to a graphics memory address. Accordingly, the arrangement is vulnerable to software errors which cause an accidental write operation to a location in graphics memory, thereby destroying graphics data.

In order to obviate some of these problems several prior art schemes have been designed. In one such scheme, the graphics memory is addressed directly by the computer via the peripheral address bus. Unfortunately, in most practical graphics schemes, the graphics memory is large, often on the order of 32 K or more. Such a memory requires at least fifteen address lines in order to address each memory location and many small computers do not have more than eight address lines easily available. Thus, additional address lines must be either obtained within the unit by jumpering as with the previous scheme or by complicated address generation circuitry.

Still other prior schemes have used a graphics memory and circuitry which operates asynchronously from the computer. The resulting graphics signal is combined with the normal video character signals by means of a video mixer. Two circuitry components are linked together by the video synchronization circuitry. This arrangement also requires complicated and expensive circuitry and in many circumstances an insufficient number of address leads are physically available on the computer in order to fully implement graphics capability.

It is therefore an object of the present invention to provide graphics generation circuitry which can be retrofitted to computer display systems having existing character generation circuitry.

It is a further object of the present invention to provide graphics generation circuitry which is capable of providing full graphics capability without requiring expensive or complex circuitry and with a minimum of interface lines.

It is still another object of the present invention to provide graphics generation circuitry which can easily and inexpensively be attached to existing video character generation circuitry in a small computer system.

It is yet a further object of the invention to provide graphics generation circuitry which does not require an additional software program to translate between physical X and Y locations on the video screen and internal graphics memory addresses.

SUMMARY OF THE INVENTION

The foregoing problems are solved and the foregoing objects are acheived in one illustrative embodiment of the invention in which graphics generation circuitry is interfaced to the computer via the normal peripheral data and address busses. Signals on the computer address bus are interpreted by the graphics circuitry as commands rather than as addresses. In accordance with such commands, data on the computer peripheral data bus is interpreted as either a graphics address or graphics data.

The inventive graphics circuitry normally operates asynchronously with respect to the computer. When synchronization is necessary it is achieved by means of a "wait" signal, normally found on small computers, which causes the computer processing to halt temporarily. The graphics circuitry is synchronized to the video character generation circuitry by means of a "character clock" signal generated by the video character generation circuitry normally present in the computer.

Advantageously, internal circuitry is also included which automatically increments graphics addresses each time new graphics data is read or written into the graphics memory. This circuitry relieves the computer of having to update graphics addresses continuously if a "line" is required to be drawn on the CRT screen. Under many conditions, this arangement will result in a much increased software speed.

DETAILED DESCRIPTION

Figure 1:
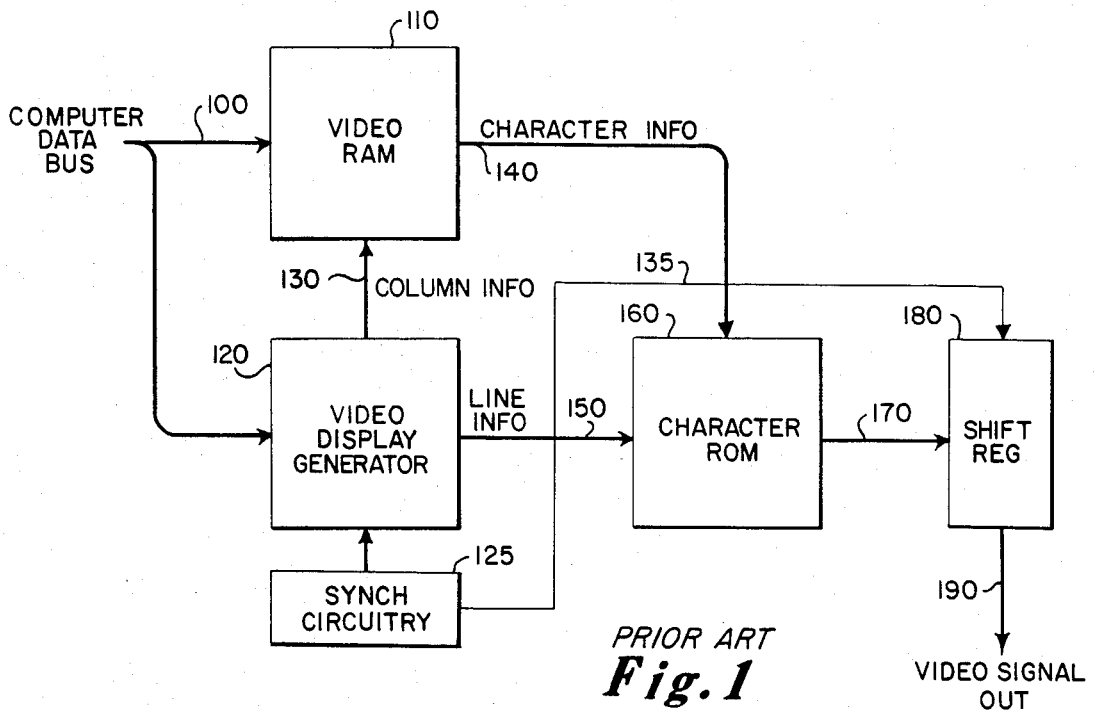
PRIOR ART Fig. 1
FIG. 1 shows a block diagram of typical video character generation circuitry.

FIG. 1 shows, in block diagram form, a typical, well-known arrangement for the generation of alpha or numeric characters in a computer-controlled cathode-ray display system using a display operation known as dot-matrix raster-scan operation. The construction and operation of such character generation circuitry is well-known in the art and will not be described in detail herein. Generally, the display of alpha or numeric characters on the CRT screen is controlled by signals stored in the video random access memory (RAM) 110. In order to control the format of the screen, the computer, under control of the software program, inserts character "codes" in order into video RAM 110 via the computer data bus 100. These character code signals are typically stored in ASCII code in which a unique 8-bit code word is used to represent each alpha or numeric character.

Read-out and display of the codes stored in RAM 110 is carried out by video display generator (VDG) 120. VDG 120 is a well-known device which is available in integrated circuit form, and produces synchronizing and address signals that are applied to RAM 110 to sequentially read out the coded information. VDG 120 receives format information from the computer over the computer data bus 100 which information specifies various timing and spacing variables, such as the character size, number of characters on a line and number of lines to be shown on each screen. VDG 120 also receives a video synchronizing signal from synchronizing circuitry 125 which signal synchronizes its output signals to ensure a stable and jitter-free display of information of the video screen.

In particular, VDG 120 produces selection signals on leads 130. The information on lead 130 specifies which "column" (character location) on the video screen is being scanned. The column information on leads 130 is provided as an address signal to RAM 110. In response to the signals on leads 130, RAM 110 sequentially produces the character code information previously stored in various locations by the computer. The character information is provided over bus 140 and used as a partial address for character ROM 160. The address is completed by "line" information provided over leads 150 from VDG 120. The "line" information indicates to the ROM which line on the CRT screen is presently being scanned.

Character ROM 160 is a read-only memory which contains video dot information for each of the alpha or numeric characters to be generated by the system. In response to the address signals occurring on leads 130 and 150, character ROM 160 produces a set of dot signals which are provided, via bus 170, to shift register 180. The information in register 180 is then shifted out under control of a dot clock signal produced by synchronization circuitry 125 on lead 135 to produce the video signal output on lead 190.

Figure 2:
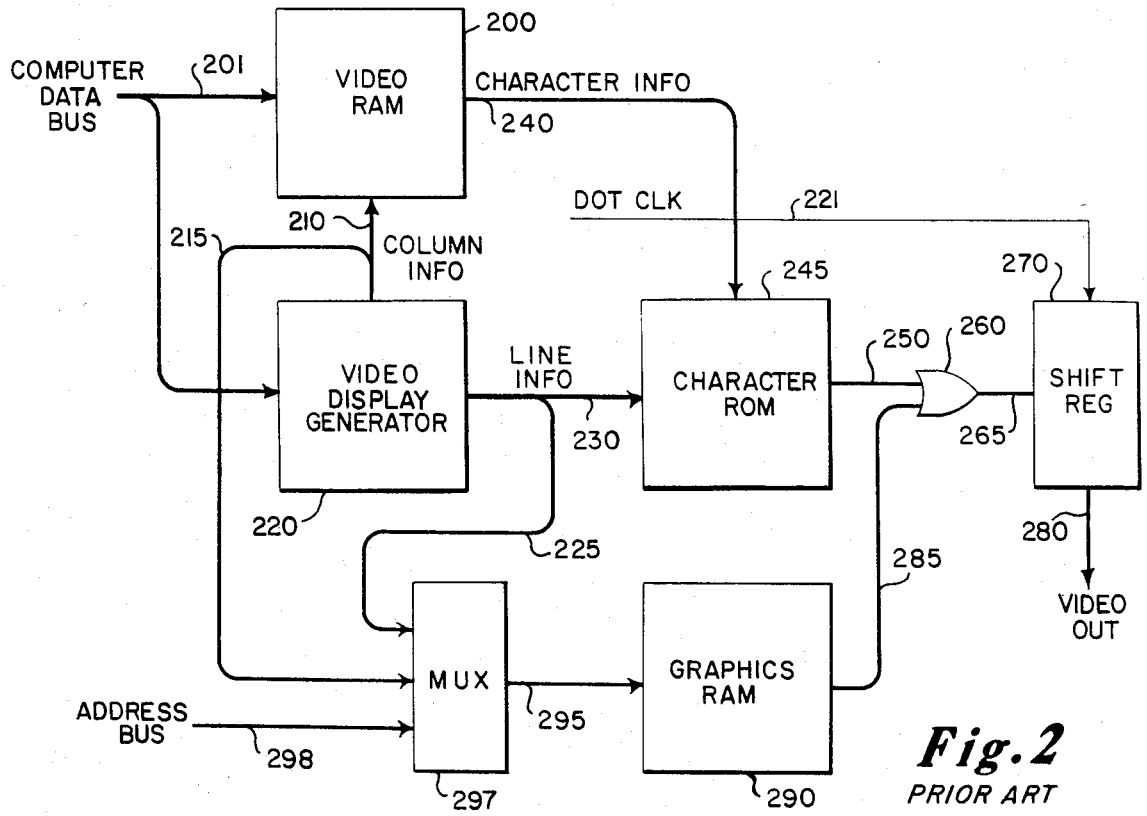
Fig. 2 PRIOR ART
FIG. 2 shows a block diagram of a typical prior art graphics arrangement which can be retrofit to the character generation circuitry shown in FIG. 1.

FIG. 2 shows a prior art scheme of retrofitting graphics circuitry to the character generation circuitry shown in FIG. 1. This composite circuitry generates characters by means of the same circuitry shown in FIG. 1. In particular, character codes and format information are provided, via data bus 201, to video RAM 200 and VDG 220. VDG 220 generates address information which is applied via leads 210 and 230 to the video RAM 200 and character ROM 245 respectively. In response to line information on leads 230 and character information produced by RAM 200 on lead 240, character ROM 245 generates dot patterns on leads 250. The information appearing on leads 250 is provided by gate circuit 260 and bus 265 to shift register 270 which is then shifted out under control of the dot clock on lead 221 (produced by synchronizing circuitry, not shown) to produce the character output on lead 280.

In addition to driving character ROM 245, the video display generator 220 is arranged to drive, via mulitiplexer 297, a graphics RAM 290. In particular, the column information generateo by VDG 220 is provided, via lead 215, to multiplexer 297 and the line information on lead 230 is provided to multiplexer 297 by lead 225. Unoer control of a software program in the computer, either these address signals or address signals generated directly by the computer on address bus 298 may be applied via bus 295 to the address input of graphics RAM 290. The output of graphics RAM 290 on lead 285 can be provided as an alternative input to gates 260 and, via bus 265, to shift register 270.

One problem with such a scheme, however, is that in order to provide full graphics capability there must be available a large number of separate address lines in bus 298 in order to be capable of addressing each location in graphics RAM 290. Typically, only a limited number of address lines are available and therefore not all locations in RAM 290 can be directly accessed by the computer.

Figure 3:
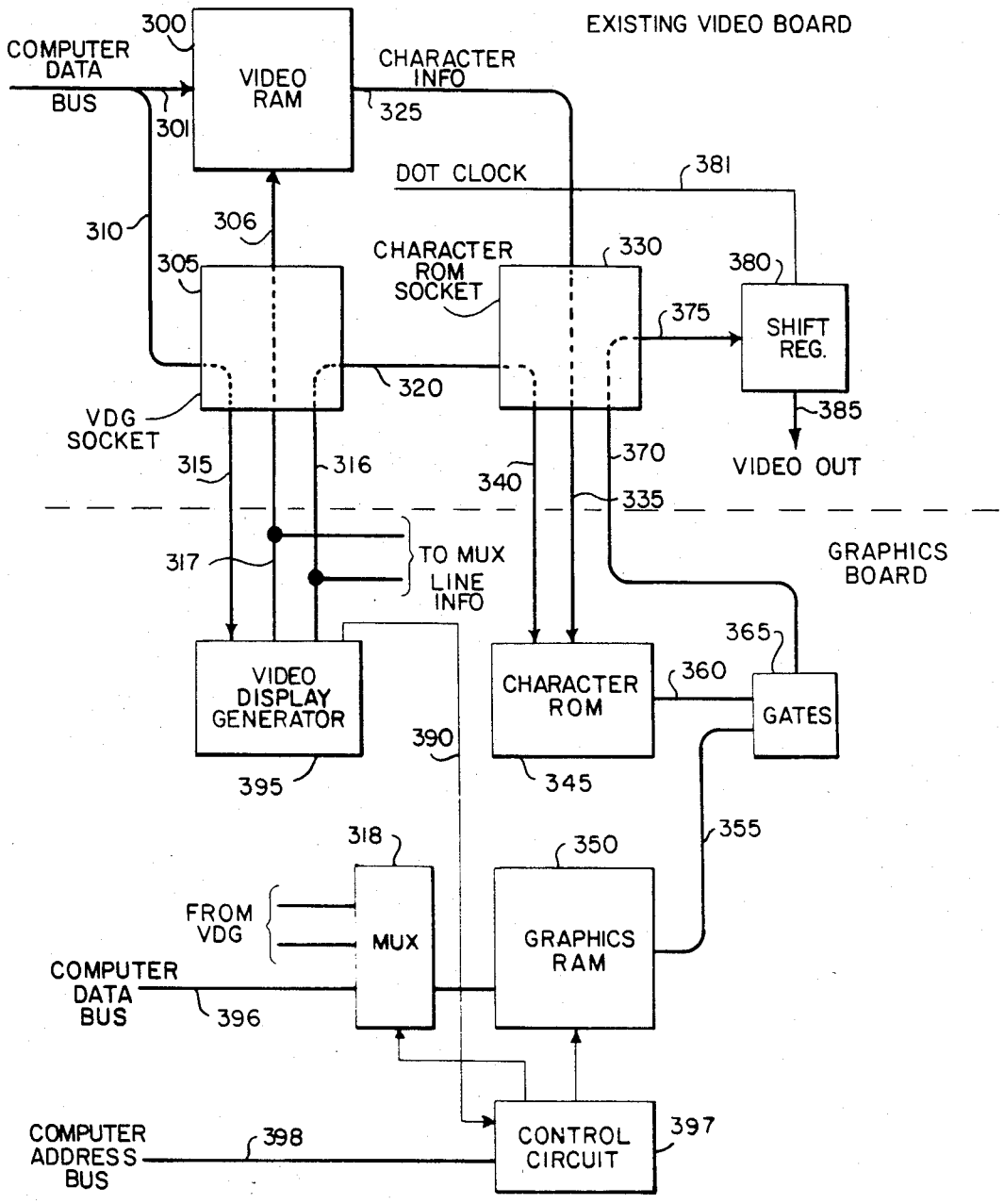
FIG. 3 of the drawing shows a block diagram illustrating the attachment of the inventive grahics generation circuitry to a typical video character generation circuit.

FIG. 3 of the drawings shows a block diagram of an illustrative embodiment of the invention which can be easily retrofitted to an existing video character generation board. The inventive graphics circuitry must have access to various timimg signals generated by the VDG and to the input of the video shift register. One way of obtaining physical access to such points is to place jumpers onto appropriate points in the exisitng character generation circuitry. A more convenient way is illustrated in FIG. 3 which may be used when the VDG and character ROM are plugged into electrical sockets of the character generation board. The circuitry in the existing character board is shown above the dotted line in FIG. 3 and consists of RAM 300, VDG 305, character ROM 330, and shift register 380. A portion of the illustrative graphics circuitry is shown schematically below the dotted line.

In order to connect the illustrative graphics generation circuitry to the character generation circuitry, VDG 305 and character ROM 330 are physically removed from their electrical sockets and placed in corresponding electrical sockets located on the graphics board. In place of VDG 305 and character ROM 330, special plugs are inserted which route the signals normally received by the VDG and character ROM to the graphics board as will be hereinafter discussed.

In particular, character codes are provided via computer data bus 301 to the video RAM 300 by the computer as previously discussed. However, format information, provided via computer data bus leads 310, is now routed to VDG located on the graphics board via socket 305 and leads 315. Column information on lead 317 and line information on lead 316 produced by VDG 395 is routed, via VDG socket 305 and leads 306 and 320, to video RAM 300 and character ROM socket 330, respectively.

From character ROM socket 330, the line information is rerouted, via lead 340, to character ROM 345 now located on the graphics board. In addition, character information on lead 325 generated by RAM 300 is routed via socket 330 and lead 335 to character ROM 345. The output of character ROM 345 appearing on bus 360 provided to logic gates 365. An alternative input to gates 365 is provided by the graphics RAM 350 via output bus 355. The character or graphics output of gates 365 is, in turn, provided, via bus 370, character ROM socket 330 and bus 375, to shift register 380.

Contrary to the prior art arrangement shown in FIG. 2, and in accordance with the invention, address signals on the computer address bus 398 are not provided directly to graphics memory 350 but are instead provided to control circuit 397. As will hereinafter be described in detail, under control of the address signals received over the computer address bus and synchronizing signals received over leads 390 from VDG 395, control circuit 397 controls multiplexer circuit 318 and memory 350 to apply alternatively either position signals generated by VDG 395 or data present on the computer data bus 396 as address signals to memory 350.

Figure 4:
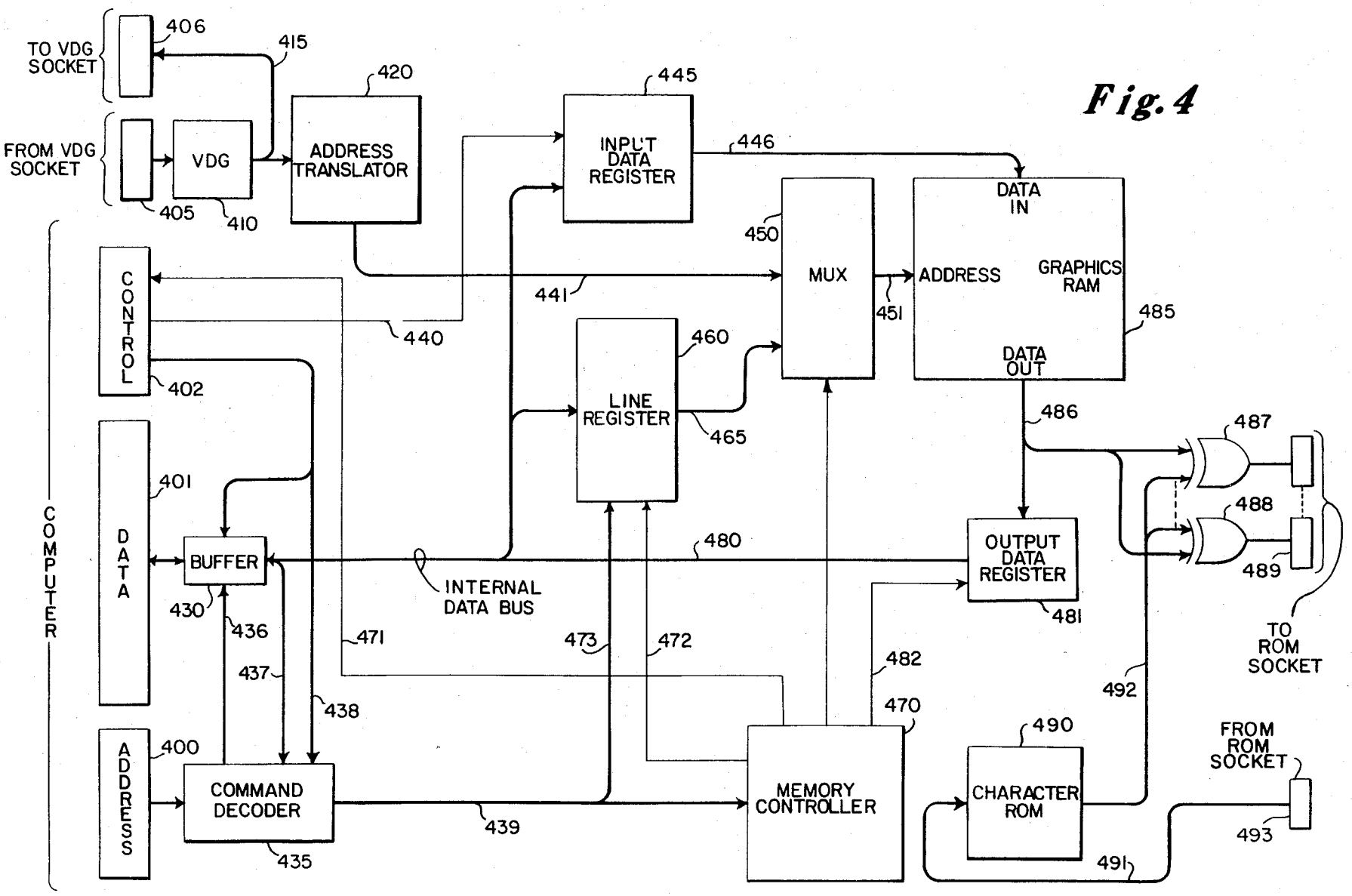
FIG. 4 of the drawing shows a block diagram of the inventive character generation circuitry.

FIG. 4 of the drawings shows a more detailed block diagram of the illustrative graphics circuitry. The circuitry interfaces to the computer via the normal peripheral interface busses: address bus 400, data bus 401 and control bus 402. In addition, the circuitry receives format control signals from the VDG socket located on the existing character generator board via connector 405 and address signals from the character ROM socket via connector 492.

Signals produced by the graphics circuitry are passed back to the computer, via data bus 401, and back to the VDG socket via connector 406 and to the video shift register via connector 489 and the ROM socket.

In accordance with the invention, the illustrative graphics circuitry decodes address signals on bus 400 as commands to perform predetermined operations or to interpret data located on data bus 401 as either a graphics address or graphics data. In particular, address signals on bus 400 are provided to a command decoder 435. A predetermined number of bits in the address signal are used to determine when the graphics board is being accessed. The number of bits required depends on the specific application and may range from 2 to 8 bits for a practical system. A portion or all of the remaining bits are used to specify the command desired by the computer.

In addition, data on data bus 401 may be provided to the command decoder, via buffer 430, internal data bus 480 and leads 437, to supplement or change information stored therein which specifies various user-programmable options which control the operation of the graphics circuitry. Decoder 435 also receives signals from control bus 402, via leads 438, indicating whether the operation requested by the computer is a read or write operation and whether the circuitry is to be reset.

In particular, since the graphics circuitry runs asynchronously with respect to the computer, data on bus 401 must be buffered and controlled by the graphics circuitry. Buffering is accomplished by buffer circuitry 430 which may be enabled by means of lead 436 by the command decoder. When buffer 430 is not enabled, internal data bus 480 remains in an inactive (high impedance) state thereby making the illustative graphics circuitry "transparent" to the computer system. In addition, device 430 receives signals from the computer over control bus 402 indicating whether data is to be transferred from the computer to the graphics circuitry or vice versa. Incoming data in device 430 is placed on an internal data bus 480 which is used to transfer information between the buffer circuitry and various devices within the graphics circuitry.

For example, information in device 430 which is to be interpreted as graphics data may be provided, via internal data bus 480, to the input data register 445 which temporarily stores incoming video graphics data. The data in register 445 is provided, via bus 446, to the input port of graphics RAM 485 for a graphics "WRITE" operation. Register 445 can also be controlled directly by the computer and may be cleared via signals on control bus 402 over lead 440.

Graphics RAM 485 may also be interrogated by the computer. In order to accomplish this operation, the computer provides appropriate address information to RAM 485. The output data appearing on lead 486 is provided to the output data register 481 which is controlled by memory controller 470 by means of lead 482. Register 481 applies the outgoing data to internal data bus 480 and the outgoing data is entered in device 430 for transfer into the computer over data bus 401.

Advantageously, according to the invention, address information can be provided to graphics RAM 485 from two alternative sources by means of lead 451 and multiplexer 450 under control of memory controller 470; multiplexer 450 may apply address signals to RAM 485 from either line register 460 or address translator 420. However, regardless of the source of address information, graphics RAM 485 is arranged so that the row and column addresses which are used to specify a location in the memory 485 correspond directly with the X and Y addresses which are used to specify a physical location on the video CRT screen. Therefore, due the physical position and memory address correspondence, the computer need only specify X and Y addresses to the graphics circuitry and information will be displayed on the video screen at the corresponding X and Y location. No additional software program is necessary to translate X and Y positions variables to internal memory addresses.

Specifically, the computer may directly display information at any physical location on the video screen by placing X and Y address information specifying the screen location in line register 460 which can then be applied by multiplexer 450 directly as an address to RAM 485. Alternatively, RAM 485 can be "scanned" by means of address signals produced by address translator 420. Address translator 420 produces such address signals under control of the address information provided by VDG 410. Translator 420 is necessary to translate the address information produced by VDG 410 into the X and Y addresses suitable for directly addressing RAM 485.

More particularly, line register 460 consists of two parts: an X-address register and a Y-address register. Each portion of line register 460 can be loaded separately, via the internal data bus 480 and device 430 from the computer data bus 401. Therefore, in order to read or write information into a particular location in memory for display on the corresponding spot on the video screen, the computer performs three operations—first loading the X-address into the line register, then loading the Y-address into the line register, and finally, performing a read or write operation for the data to be placed in the specified location. Since the data bus is used for several consecutive addressing operations, the entire memory may be addressed with a limited number of data leads.

In addition, according to the invention, line register 460 may be controlled by memory controller 470 over lead 472, and by command decoder 435, via lead 473, in order to automatically increment or decrement either the X address, the Y addresss or both of the addresses stored therein each time a READ or WRITE operation is performed. Therefore, in order to generate a "line" on the video display screen, the computer need only place the appropriate command codes to address bus 400 and then sequentially apply video graphics data to bus 401 in order to generate a line on the video screen. This automatic operation relieves the computer of the normal input routine in which both an X-address and a Y-address must be provided to the graphics board for every write or read operation and considerably speeds up the software operation in drawing lines and other figures.

Alternatively, graphics RAM 485 may be continuously scanned under control of VDG 410. As previously described, VDG 410 sequentially produces line and column "scanning" signals. These signals are provided to the video RAM located on the existing character generation board via lead 415 and connector 406 to provide character generation as with the typical previous arrangement. In addition, these signals are provided to address translator 420 which translates the signals into the X and Y addresses necessary for directly accessing graphics RAM 485. The translated address signals are provided via lead 441 to an input of multiplexer 450 under control of appropriate command decoder 435. Under appropriate commands from the computer, memory controller 470 controls multiplexer 450 to apply the scanning signals to RAM 485. This causes the locations in RAM 445 to be sequentially scanned to produce a graphics display.

The output of graphics RAM 485 on bus 486 can be provided directly to the computer, via output data register 481, as previously described, or may be provided to the video display screen via a set of logic gates schematically designated as 487 and 488 (only two gates are shown for clarity, however, it is to be understood that a logic gate is to be provided for each output lead in the data bus 486). The outputs of gates 487 and 488 are provided to the video shift register via terminal 489 and the existing character ROM socket.

Gates 487 and 488 can also be driven via lead 492 from the output of character ROM 490. As previously described, ROM 490 receives address signals from the existing ROM socket via terminal 493 and lead 491. The choice between alpha numeric signals or graphic signals is made via command decoder 435 which disables or enables the output of graphics RAM 485 as will be hereinafter described.

Figure 5:
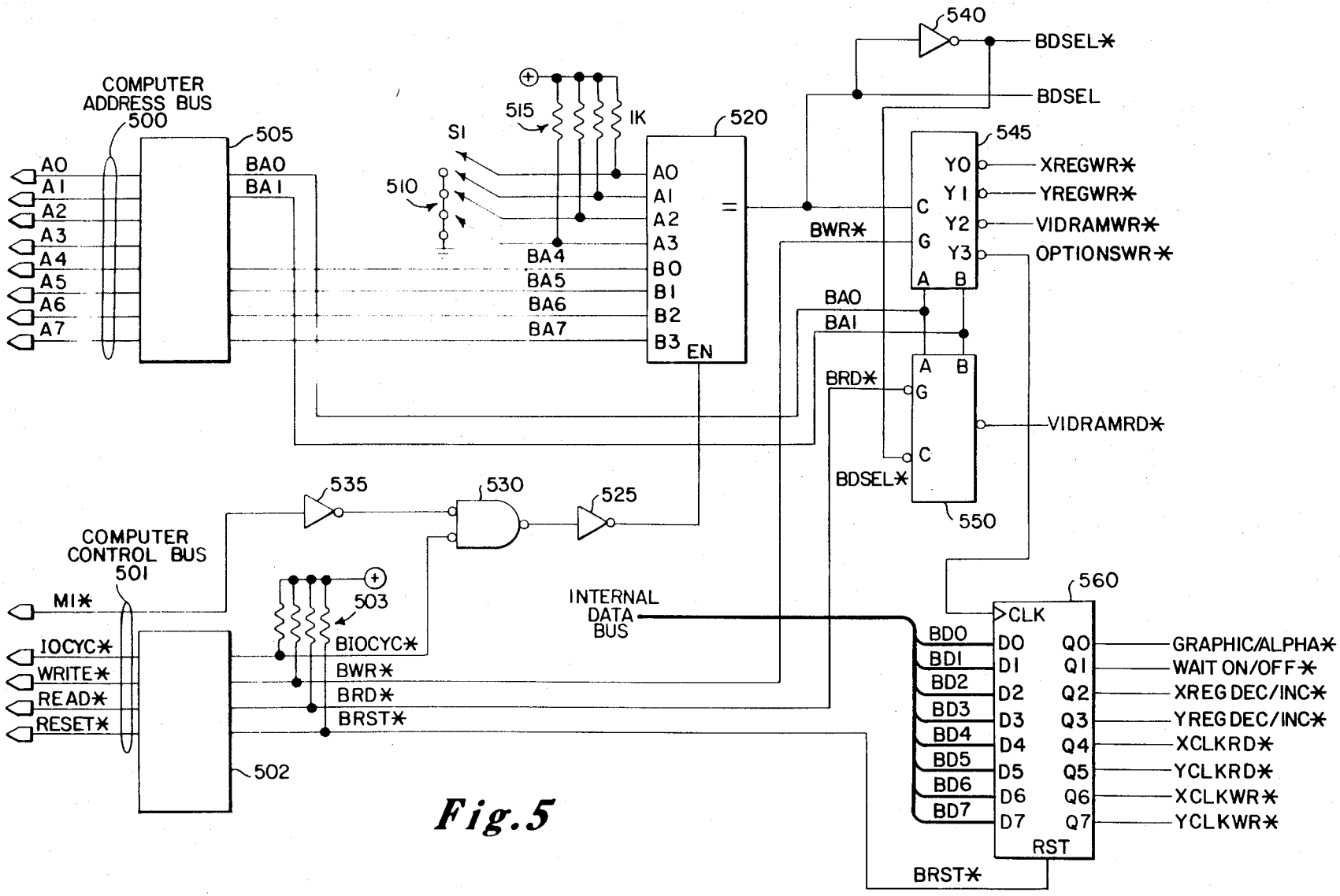
FIG. 5 of the drawing shows a detailed electrical schematic of the command decoder.

FIG. 5 shows a detailed electrical schematic of the command decoder. As previously described, this circuitry receives address and control signals from the computer peripheral busses and translates them into various commands which are then used to control operation of the circuitry or interpret various signals present on the data.

In particular, the command decoder circuitry receives address signals on bus 500 and control signals from bus 501 located at the left hand side of the Figure. The decoded command signals are produced on the leads shown on the right hand side of the Figure. All signals are fully buffered to insure no loss of information, therefore, the address signals on the address bus 500 (appearing on leads A0–A7) are provided to buffer gates 505. Similarly, each control signal on bus 501 is buffered by buffer device 502. Device 502 is an "open collector" device and therefore, resistors 503 must be used to pull the outputs up when they are not active.

Signals appearing on the buffered address outputs BA0–BA7 are decoded to produce the command information which controls the operation of the circuitry. Command decoding is accomplished by 4-bit comparator 520 and two decoders 545 and 550. Four of the buffered address lines, BA4–BA7, provided to the "B" inputs of comparator 520. The "A" inputs may be predetermined by the settings of multi-pole switch S1. Each of the "A" inputs of comparator 520 is normally held in a "1" state by resistors 515. However, each pole of switch S1 may be connected to ground, via contacts 510, to produce a predetermined configuration of address signals signifying that the graphic circuitry is to begin operation. In the illustrative embodiment shown the use of four bits allows the use of sixteen different addresses which allows the circuitry to be compatible with all 8-bit computers. In accordance with well-known principles specific applications can be permanently wired to eliminate switch S1.

When comparator 520 is enabled by a "1" signal appearing at its EN input, the "B" inputs are compared to the "A" inputs for a "match". An enable signal is produced by gates 525, 530 and 535 in response to a particular pattern of control signals present on the control bus 501. Specifically, when the computer is operating on an input/output instruction, the lead IOCYC* of bus 501 becomes "low". The "low" signal is applied to buffer 502 and causes lead BIOCYC* to become "low" (under the notation used in this description, a "*" following the specification of a signal lead indicates that the lead is active when it is in a "low" state). A "low" signal on the BIOCYC* lead is provided to the lower input of gate 530. Since the computer may be performing several types of input/output operations when the signal on lead IOCYC* becomes "low", it is necessary for the graphics circuitry to examine further information before responding. Specifically, during a FETCH operation to an associated peripheral, such as a disc, the computer asserts a "low" signal on terminal Ml*. In the absence of a FETCH operation indicating a graphics operation, a "high" signal is produced on terminal M1* which signal is inverted by inverter 535 and applied to the upper input of gate 530. Responsive to "low" signals on both of its inputs, gate 530 produces a "low" signal on its output which is inverted by inverter 525 and applied as a "high" signal to the EN input of comparator 520. Therefore, under the conditions when the computer is performing an input/output cycle, is not doing a FETCH and the predetermined address is present on address leads BA4-BA7, comparator 520 is enabled and produces a "high" signal on its "=" output. This high signal is applied to lead BDSEL and inverted by inverter 540 and applied as a "low" signal to lead BDSEL* to enable the graphics circuitry.

In particular, the signals on leads BDSEL and BDSEL* are provided to the data inputs of decoders 545 and 550, respectively. Decoders 545 and 550 are enabled under control of signals on the computer control bus 501. Specifically, during a write operation in which data is to be transferred from the computer to the graphics board, the computer places a "low" signal on its WRITE* lead which appears as a "low" signal on lead BWR*. This "low" signal enables decoder 545. Likewise, during a READ operation, a "low" signal placed by the computer on its READ* terminal causes a "low" signal to be placed on lead BRD* which in turn, enables decoder 550.

Decoders 545 and 550 are nearly identical, with the exception that data applied to the C input of decoder 545 is inverted at its output, but data applied to the C input of decoder 550 is not inverted at its output. This inversion is accounted for by applying the signal BDSEL to the C input of decoder 545 and the inverted signal BDSEL* to the C input of decoder 550. Both of the decoders are well-known circuit devices and function in a similar fashion. In particular, when a "low" signal is applied to the gate input G of the decoder and a high input is applied to its data input C, a "low" signal appears on one of the output leads Y0–Y3, depending on the selection signals provided to the select inputs A and B. Since the select inputs of both decoders 545 and 550 are connected to the address bits BA0 and BA1, the commands produced by the command decoder depend on the state of the address signals. In particular, Table 1 below shows how the addresses are decoded.

TABLE 1

| ADDRESS | ACTIVE LEAD | FUNCTION |
|---|---|---|
| Z0 Hex | XREGWR* | X-register write |
| Z1 Hex | YREGWR* | Y-register write |
| Z2 Hex | VIDRAMWR*/VIDRAMRD* | Video data read/write |

TABLE 1-continued

| ADDRESS | ACTIVE LEAD | FUNCTION |
|---|---|---|
| Z3 Hex | OPTIONSWR* | Options write |

In the table, "Z" stands for the four-bit address which is set by switch S1.

The X-register write and Y-register write functions allow graphics addresses to be entered directly from the computer data bus as will be hereinafter explained. Similarly, the video data read/write signal informs the graphic circuitry that the signals present on the data bus are video data signals.

When the options write command is decoded by the command decoder, a "low" signal appears on the OPTIONSWR* lead. This "low" signal is applied to the clock input of a data latch 560 which serves as an options register. The data inputs of the options register receive data over the computer data bus as will hereinafter be explained. This data appears on leads BD0–BD7 and will be clocked into the latch by the signal on the OPTIONSWR* lead appearing at outputs Q0–Q7. By appropriately manipulating data stored in the options register under software control, user programmable options can be selected. Such options are described in Table 2 below.

TABLE 2

| BIT | NAME | FUNCTION |
|---|---|---|
| 0 | GRAPHICS/ALPHA* | Turns "on" and "off" the graphics circuitry. A "1" will turn the graphics "on". |
| 1 | WAITS ON/OFF* | If the WAITS option is selected, the screen will not "hash" when reading or writing to the graphics RAM. A "1" selects WAITS. |
| 2 | XREG DEC/INC* | Selects if the X address will automatically increment or decrement. A "1" is decrement. |
| 3 | YREG DEC/INC* | Selects if the Y address will increment or decrement. A "1" is decrement. |
| 4 | X CLK RD* | If selected, causes the X address to be incremented or decremented after a READ operation. A "0" will select this option. |
| 5 | Y CLK RD* | Selects automatic clocking after READ for Y address. Selected by a "0" |
| 6 | X CLK WR* | Selects automatic incrementing or decrementing of the X address after a WRITE operation. The option is selected by a "0". |
| 7 | Y CLK WR* | Selects if the Y address will increment or decrement after a WRITE operation. Selected by a "0". |

In order to clear the options register, the computer places a "low" signal on its RESET* line which is applied as a "low" signal to the BRST* line which clears register 560.

Figure 6:
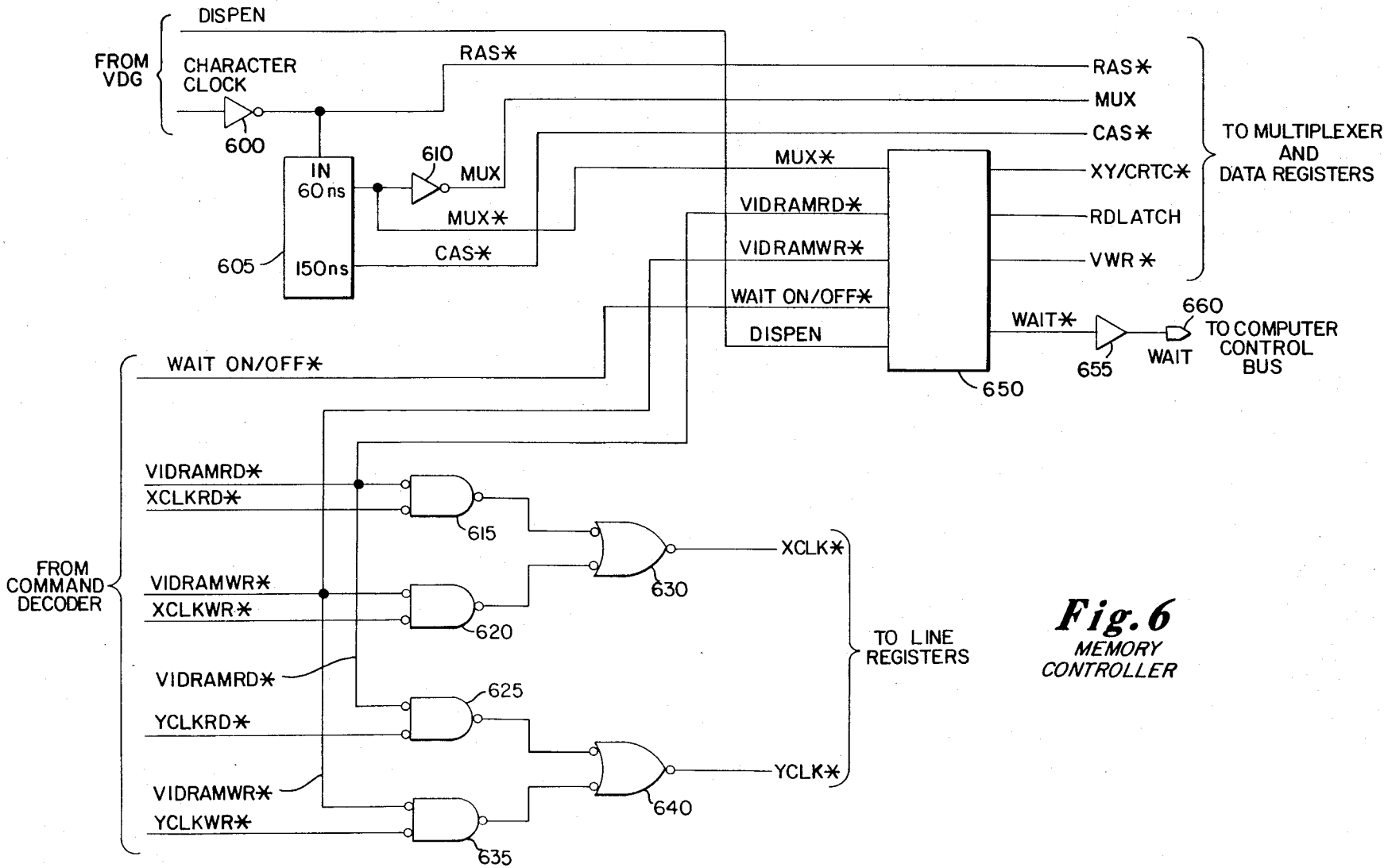
FIG. 6 of the drawing is a detailed electrical schematic of the memory controller.

The memory control circuitry which is used to control the graphics memory multiplexer, the line register and the output data registers is shown in FIG. 6. In particular, the circuitry which provides control signals that operate the multiplexer for the graphics RAM addresses includes inverter 600, delay line 605 and inverter 610. This circuitry is driven by the character clock line CCLK which is derived from the video display generator chip which has been transplanted to the graphics board from the original character generator circuitry. The use of this signal advantageously allows the graphics circuitry to be synchronized with the character generation circuitry. The memory multiplexer and the synchronization signals produced by the memory control circuitry are shown in the illustrative embodiment for use with dynamic random access memories. It is also possible to use static random access memories with the inventive graphics circuitry. If static memories are used the multiplexer circuitry and timing circuitry can be changed in well-known ways to operate with such memories. Dynamic memories are preferred because of their lower cost and smaller size.

Specifically, the character clock signal appearing on lead CCLK is a squarewave with a period corresponding to the character time which is the horizontal scan time divided by the number of dots on a line. The CCLK signal is inverted by inverter 600 to produce a signal RAS* which is used to control the operation of the graphics memory. The RAS* signal is provided to the input of digital delay line 605. This is a well-known delay circuit which provides delayed outputs at intervals of 60 nanoseconds and 150 nanoseconds after the appearance of a signal at its input. The 60 nanosecond delayed output provides the signal MUX* which is provided to sequencer 650 in order to control its operation as will be further described. The MUX* signal is inverted by inverter 610 to produce the MUX signal which is applied to the graphics RAM address multiplexer to control its operation as will be hereinafter described. The output of delay circuit 605 occurring at 150 nanoseconds is used to produce the signal CAS* which is also used to control the operation of the graphics memory.

The memory control also includes circuitry which implements the clocking to automatically increment the line registers during read or write operations. This circuitry consists of gates 615–640 and receives signals from the command decoder circuitry shown in FIG. 5.

In particular, during a READ operation, the command decoder will respond to command signals by placing a "low" signal on the VIDRAMRD* line, enabling gates 615 and 625. If as previously described, the X-CLOCK READ automatic incrementing option has been selected by the user, a "low" signal will also appear on lead X CLK RD*. In response to "low" signals at both of its inputs, gate 615 will be enabled. Enabled gate 615 applies a "low" signal to the upper input of AND gate 630 which in turn applies a "low" signal to output XCLK*. As will be hereinafter described, this output signal causes the X line register to automatically increment or decrement, depending on the option selected by the user.

If, on the other hand, automatic incrementing on the Y-address is selected, a "low" signal produced by the command decoder on lead Y CLK RD* will enable NOR gate 625 producing a "low" output to OR gate 640 which in turn produces a "low" output on lead YCLK*. The YCLK* signal will automatically increment Y line register.

Similarly, during a WRITE operation, the line VIDRAMWR* lead becomes "low" enabling gates 620 and 635. Under control of the command decoder, one or both of these gates produce "low" signals which increment the X or Y addresses during a WRITE operation in a similar fashion as described for READ operations.

The memory control circuitry also includes a sequencer circuit 650 which generates control signals that control the multiplexer and data registers and synchronize the graphic circuitry to the computer circuitry using the WAIT* line. This circuitry is not shown in detail for it may be implemented in several different ways. One suitable way is by using programmable logic arrays to provide a custom sequencing circuit or "state" machine. The circuit receives as inputs the MUX* line from the multiplexer control circuitry in FIG. 6; the VIDRAMRD*, VIDRAMWR* and the WAIT ON/-OFF* lines from the command decoder, and a display enable line, DISPEN, from the transplanted video display generator. The DISPEN signal signal is held "high" by the VDG whenever the CRT beam is scanning with in the raster. The signal is used when the WAIT ON/OFF* option is enabled to suspend memory accesses when the display is enabled to prevent "hashing" of the screen.

The sequencing circuitry 650 produces four outputs on leads XY/CRTC*, RDLATCH, VWR* and WAIT*. The XY/CRTC* and VWR* leads are used to control the operation of the multiplexers and graphics memory, respectively. The RDLATCH lead is used to control the operation of the output data register as will be hereinafter explained. The WAIT* output is used to synchronize the graphic circuitry to the computer operation as will be hereinafter described.

Figure 7:
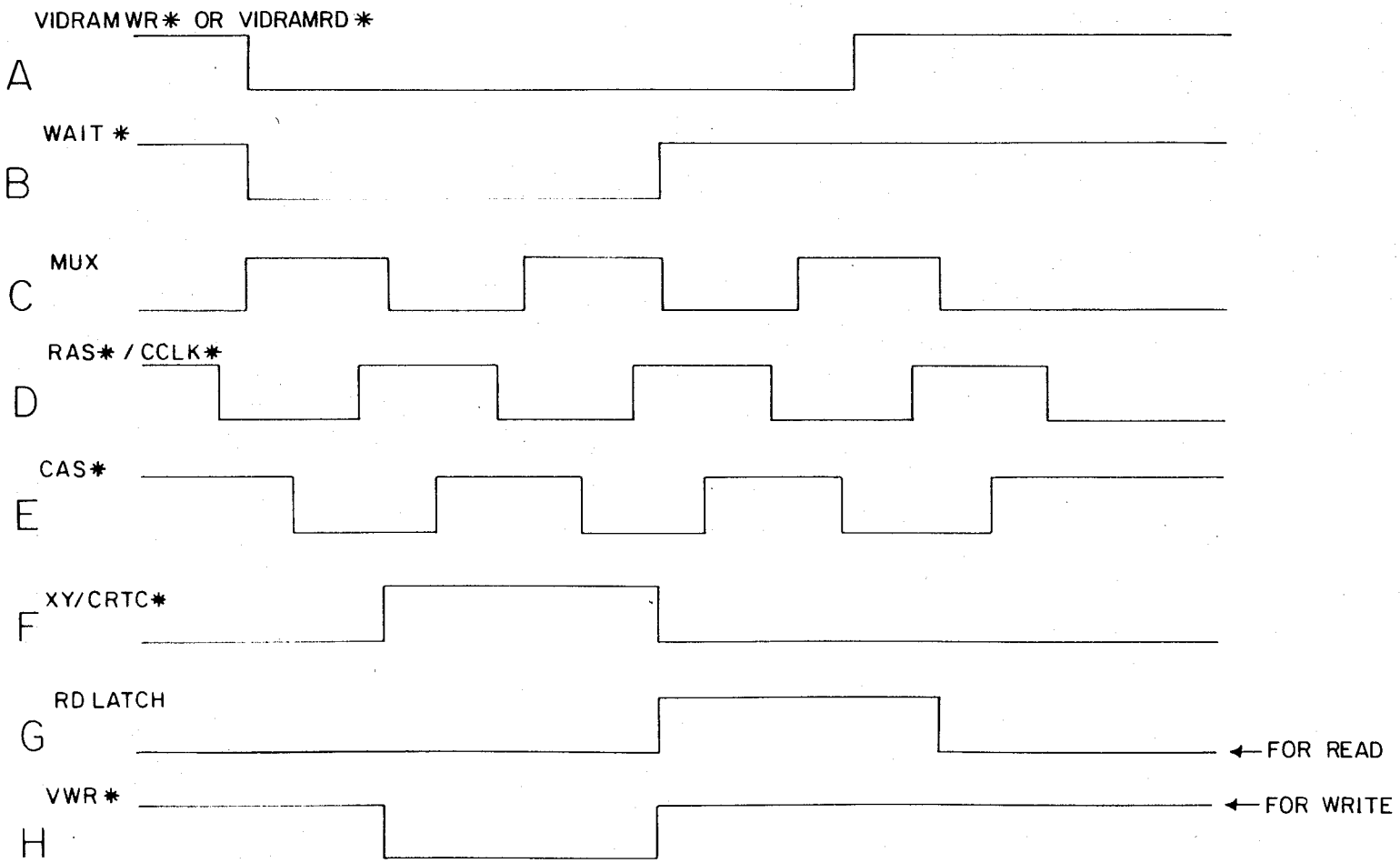
FIG. 7 of the drawing shows a series of electrical waveforms generated by the circuitry shown in FIG. 6.

The relationship of these signals is shown in FIG. 7. In particular, the sequencing circuitry receives as an input from the command decoding circuitry the VIDRAMWR* and VIDRAMRD* leads. Signals on these leads indicate commands from the processor to write graphics information into the graphics RAM or read information therefrom. As previously explained, the graphics circuitry operates asynchronously from the processor. In particular, once the VIDRAMWR* or VIDRAMRD* line has been asserted (by placing a "low" signal thereon) the operation of the memory controller sequencing circuit is controlled by the character clock CCLK which synchronizes the operation of the circuitry to the video scanning rate.

In order to synchronize the operation of the graphics circuitry to the processor operations in response to the assertion of the VIDRAMWR* or VIDRAMRD* lines, the graphics circuitry places a "low" signal on the WAIT* line. This signal halts temporarily the operation of the processor until the graphics read or write operation is completed. This sequence is shown in line B of FIG. 7.

After the WAIT* line has been placed in a "low" condition, the operation of the circuitry is synchronized to the character clock lead CCLK which is provided from the transplanted video display generator. In particular, the operation of the circuitry is synchronized to the falling edge of the MUX signal as shown in line C of FIG. 7. As described in connection with the circuitry of FIG. 6, this signal is a delayed version of the character clock signal CCLK.

On the first falling edge of the MUX signal occurring subsequent to the falling of the WAIT* signal, the sequencer 650 places a "high" signal on the XY/CRTC* lead as shown in line F of FIG. 7. The XY/CRTC* signal is used to control the operation of the graphics memory multiplexer. When the signal is "low" (its normal condition), graphics memory addresses are obtained from the video display generator. When the signal becomes "high", addresses stored in the line registers are transferred into the memory.

The actual clocking of the address information into the memory circuitry is carried out by the RAS* and CAS* signals. These signals operate in a well-known manner to control the dynamic memory to enter the memory address information. In particular, a change from "high" to "low" of the RAS* lead (row address strobe) causes row address information to be entered from the X line register into the graphics memory address port. Similarly, a change from "high" to "low" of the CAS* lead causes column information to be entered from the Y line register into the memory.

Whether the row and column address information is used for reading or writing is determined by the status of the signals on the VWR* lead. When this lead is "high", the operation is a READ operation. When the signal on the lead is "low", the operation is a WRITE operation. Assume for the moment that the processor is attempting to write information to the graphics RAM. In this case, on the same falling edge of the MUX signal when the XY/CRTC* lead becomes "high", the sequencer causes the VWR* lead to become "low" as shown in line H of FIG. 7. As stated above a change in the RAS* and CAS* signals causes the row and column information to be strobed into the memory. The memories are arranged in a well-known manner so that when the CAS* signal changes from "high" to "low", the information present at the data inputs of the memory is written into the specified row and column location.

A short time after the CAS* lead changes from "high" to "low", the MUX signal falls causing the sequencer to place low and high signals respectively on the XY/CRT* and the VWR* leads. In addition, sequencer 650 places a "high" signal on the WAIT* lead releasing the processor and completing the WRITE operation.

For a READ operation, the signals produced by sequencer 650 are similar. The operation is started when the VIDRAMRD* lead (controlled by the command decoder) becomes "low". As with the WRITE operation, the WAIT* line is immediately driven "low", halting the processor. On the next subsequent falling edge of the MUX* signal, the XY/CRTC* lead becomes "high" indicating that the address information stored in the X and Y line registers is to be used. During the performance of a READ operation, the VWR* line remains "high" indicating to the memories that a READ operation is being performed. After the row and column information has been strobed into the memory by means of the RAS* and CAS* lines as described previously, the MUX signal again falls causing the XY/CRTC* signal to fall and the WAIT* signal to rise, releasing the processor. On the concurrence of the falling edge of the MUX signal and the falling edge of the XY/CRTC* signal, the RDLATCH signal becomes "high" as shown in line F of FIG. 7. The "high" signal on the RDLATCH lead causes the data present at the outputs of the graphics RAM to be latched into the output data register. As will be hereinafter described, the outputs of the output data register are disabled until the VIDRAMRD* signal becomes "high" as shown in line A of FIG. 7. At this point, the outputs are available to the processor which receives them and uses them in subsequent processing. On the next subsequent falling edge of the MUX signal, the RDLATCH signal becomes "low", completing the READ operation.

It should be noted that the above operational sequences are started in response to the decoding of address signals to produce the VIDRAMWR*/VIDRAMRD* signals. After the sequence is started, however, operation proceeds under control of the CCLK signal independently of the operation of the computer which is halted by the WAIT* signal. Therefore, operation of the graphics circuitry is synchronized to the video scanning rate by the CCLK lead.

Figure 8A:
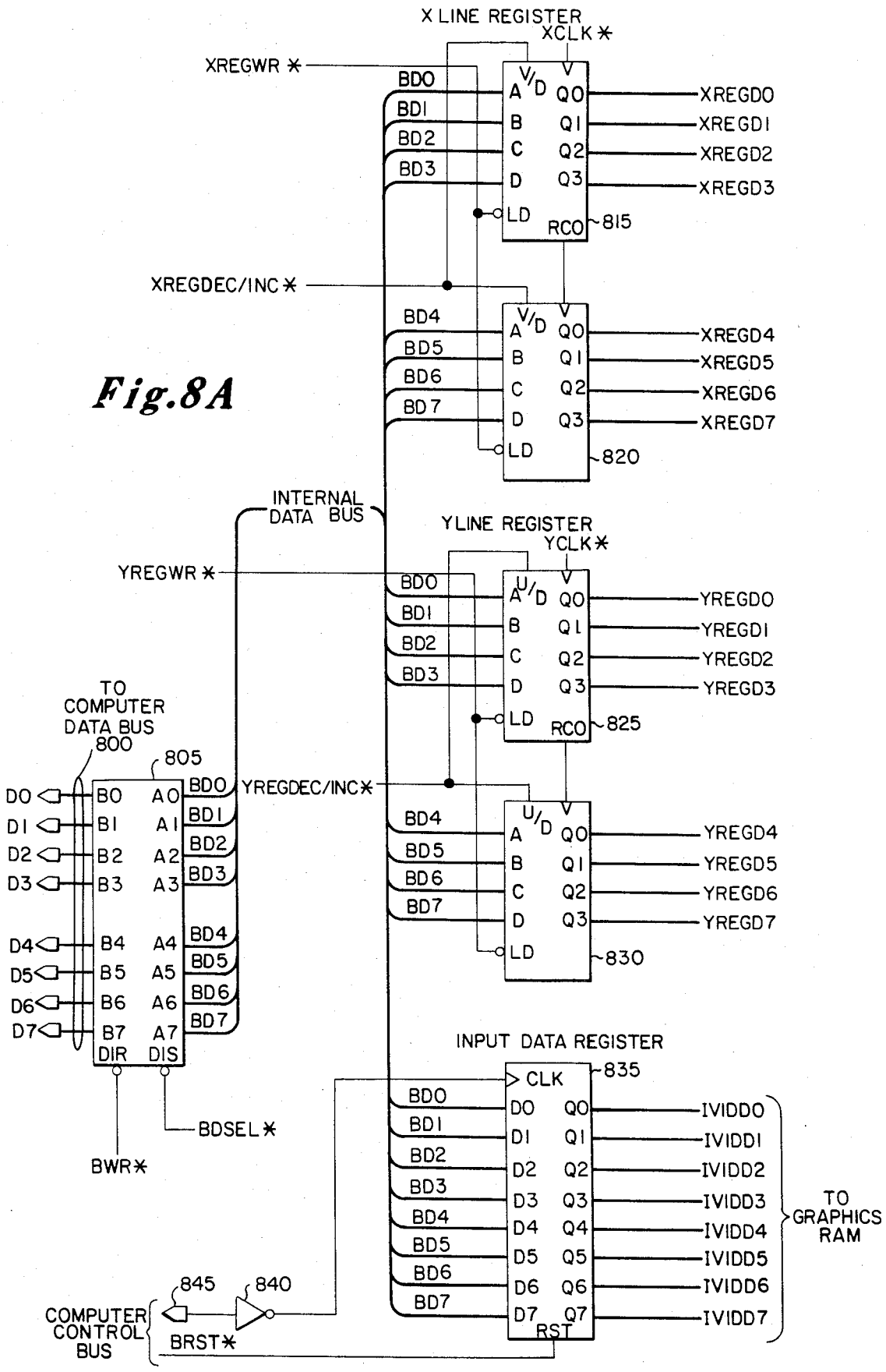
FIG. 8A of the drawing is an electrical schematic diagram of a portion of the video display generation circuitry including the X and Y line registers.

FIG. 8A of the drawing shows the arrangement of the internal data bus as applied to the X and Y line registers and the input data register.

In particular, data from computer data bus 800 as shown at the left hand side of the Figure appears on pins D0–D7. Since as previously described, the output of the graphics circuitry must be controlled by the circuitry, the data must be buffered. This operation is performed by bi-directional buffer 805. Buffer 805 has two control inputs, DIR and DIS. The DIR input controls the direction of transmission of the signals between the computer data bus and the internal data bus 810. It is connected to the BWR* lead which is controlled by the computer via the control bus. A "low" signal on the BWR* lead causes data to be transferred from the computer data bus 800 to the internal data bus 810. A "high" signal on the BWR* lead causes data to be transferred from the internal bus 810 to the external computer data bus 800.

The DIS input of the buffer 805 enables the buffer outputs. In order to disable the graphics circuitry when not in use, the buffer is provided with high impedance outputs. In this well-known configuration, in addition to the normal digital "1" and "0" signals, there is a third state which causes the output circuitry to assume a high impedance state. A "low" signal applied to the DIS input enables the board to pass information back and forth. A "high" signal disables the board causing its outputs to assume a high impedance state. The DIS input is connected to the BDSEL* lead which is controlled by the command decoder circuitry shown in FIG. 5. In particular, with any access to the graphics board as determined by the proper address code, the buffer is turned "on". When the board is not being accessed, the BDSEL* line is held "high" and the buffer is turned "off".

Data present on lines D0–D7 is buffered by the buffer and appears on the internal data bus lines BD0–BD7. This data is distributed over the internal data bus to the various registers.

In particular, the information on internal data lines BD0–BD7 is provided to the X and Y line registers 815–830. The X line register is composed of devices 815 and 820, and the Y line register is composed of devices 825 and 830.

Advantageously, according to the invention, each of devices 815–830 allows the addresses stored therein to be automatically incremented or decremented. Accordingly, registers 815–830 are up/down counters which can be controlled by the memory controller to accept graphics addresses and automatically increment or decrement the addresses each time a read or write operation is performed on graphics data.

Each of devices 815–830 is a bi-directional counter which has three control terminals; a clock terminal, an up/down terminal (U/D) and a load terminal (LD). Assume for the moment that an X address is to be loaded into the X line register. In this case, as previously described, the memory controller places a "low" signal on the XREGWR* line. This "low" signal is applied to the load inputs of devices 815 and 820. Responsive thereto, devices 815 and 820 load the X address information present on internal data bus leads BD0–BD7. Subsequently, the X address information appears at the X line register outputs, XREGD0–XREGD7. As will be hereinafter described, this information is provided to the memory mulitplexer and, in turn, to the graphics memory itself.

In order to automatically increment or decrement the address information stored in the X line register, a signal is applied to XREG DEC/INC* lead by the memory controller. As previously described, this signal corresponds to a user selected option which can be programmed into the control unit. A "high" signal on the XREG DEC/INC* lead causes counter units 815 and 820 to decrement each time a clock pulse is applied to their clock inputs. Correspondingly, a "low" signal on the XREG DEC/INC* lead causes counter units 815 and 820 to increment each time a clock signal is applied to their clock inputs. The clock inputs of devices 815 and 820 receive a signal from the XCLK* lead which, as previously described, produces a clocking signal each time a READ or WRITE operation is performed by the central processor. Therefore, the X address may be incremented or decremented each time graphics data is read from or written to the graphics memory.

The Y line register works in a similar fashion. Y address information is written to counter devices 825 and 830 by placing a "low" signal on the YREGWR* line. This causes information on internal buss leads BD0–BD7 to be loaded into the registers and appear at the outputs YREGD0–YREGD7. Devices 825 and 830 can then be incremented or decremented under control of signals on the YREG DEC/INC* lead and the YCLK* clock input.

After X and Y graphics addresses have been entered into the X and Y line registers, data may be entered into the selected location in the graphics memory by means of data register 835. In particular, the internal data bus leads BD0–BD7 are applied to inputs D0–D7 of the register 835. Data present on the internal data buss leads is clocked into the register under control of the computer system clock; clock signals are provided to the graphics circuitry via terminal 845, inverted by inverter 840 and applied to the clock input of input data register 835. Therefore, the data signals present on the outputs of register 835 change each computer system cycle. This operation assures that valid data is available during a READ or WRITE operation even though the graphics circuitry operates asyncrhonously with respect to the computer. The particular clocking scheme used in the illustrative embodiment is useful with computers based on Z-80 and 8080 microprocessors manufactured by Zilog and Intel. For other microprocessors different clocking schemes may be necessary for proper operation. The design of such clocking schemes would be obvious to one skilled in the art. Data latched in the input data register appears on its outputs IVIDD0–IVIDD7 and is provided to the input of the graphics memory as will be hereinafter described.

In order to clear the input data register, the computer generates a RESET signal which is converted by the memory controller to a "low" signal appearing on the BRST* lead. This low signal is applied to the reset input of register 835 to clear the information.

Figure 8B:
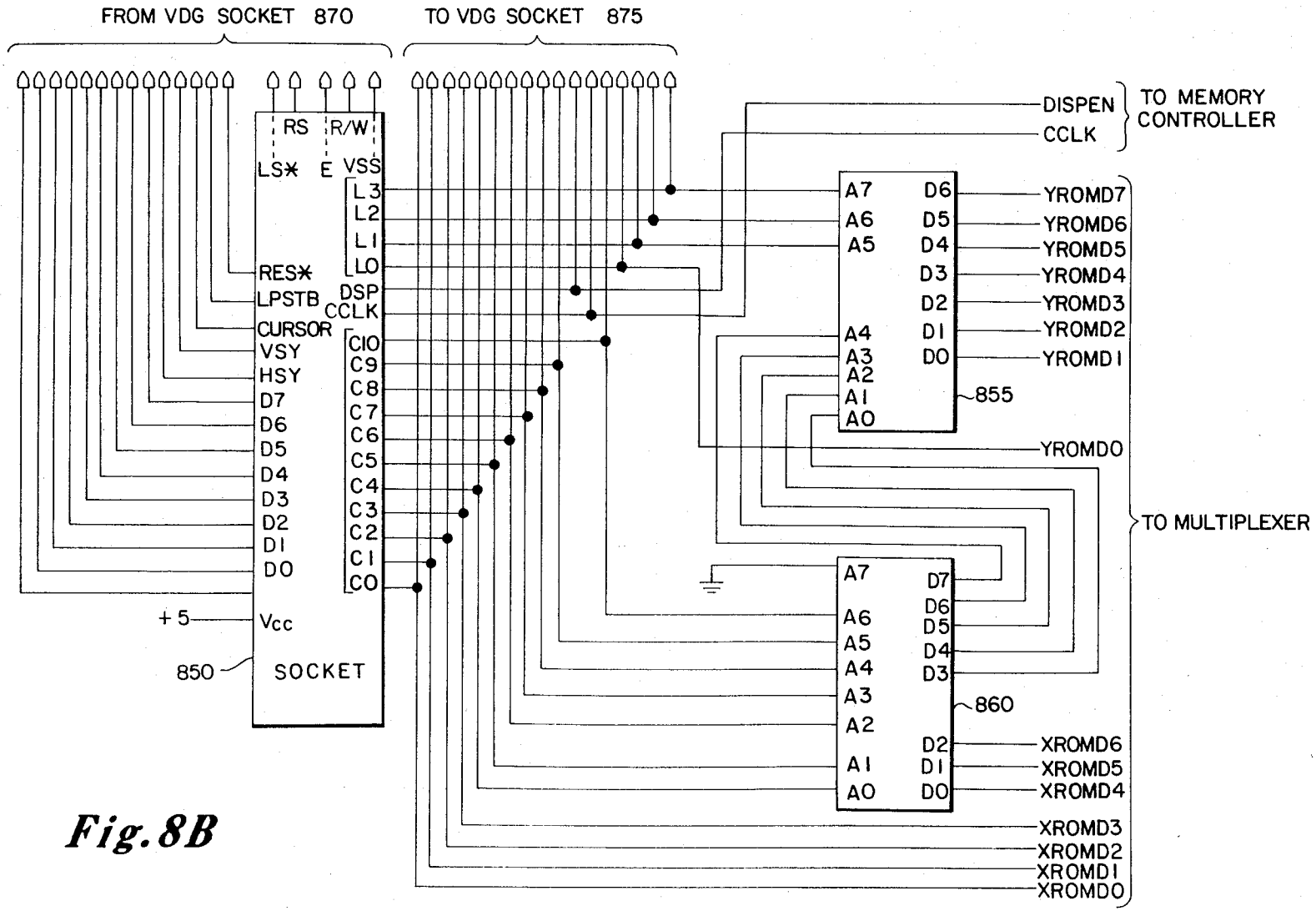
FIG. 8B of the drawing is an electrical schematic of a portion of the video display generation circuitry including the socket arrangement for the video display generator and the associated address-translating ROMs.

Shown in FIG. 8B is the socket arrangement for the video display generator and the associated address translating ROMS. As previously stated, when the video display generator (VDG) chip is removed from the character generator board and transferred to the graphics circuitry, signals are forwarded to the VDG and returned from the VDG to the character generator circuitry by means of a special plug arrangement. In particular, format control and synchronization signals are provided to the video generator chip (located in socket 850 on the graphics board) by means of the connector terminals 870. Incoming signals include data leads D0–D7, cursor control signals and various other control signals.

The output signals produced by the VDG include line and column address signals (C0–C10 and L0–L3, respectively), a display enable signal, DISPEN, and horizontal and vertical synchronization signals (HSY and VSY).

The outputs of the video display generator return to the character generator board by means of connector terminals 875. The DISPEN and CCLK signals are also provided to the graphics circuitry memory controller in order to synchronize the operation of the graphics circuitry to the video sweep circuitry as previously described. The line and column signals are also provided to translation read only memory devices 855 and 860. These memories are necessary because the VDG normally produces line and column address signals which "scan" a character ROM that is set up for a certain character size (a typical size is 8 dots × 10 dots). Therefore, the address signals do not correspond directly to the X, Y address arrangement used in the graphics memory. Accordingly, devices 855 and 860 are used to translate some of the line and column addresses produced by the VDG into the "absolute" X and Y addresses used in the graphics memory. Illustratively, devices 855 and 860 are fast (approximately 60 nanoseconds access time) bipolar PROMs which, in response to address signals provided to the A0–A6 address inputs, generate a predetermined output stored in a selected memory location at outputs D0–D7. These devices can be programmed in a well-known manner to accomplish proper translation of the address information. Other alternative arrangements, such as counter circuits, would also be apparent to those skilled in the art.

Specifically, some address produced by the VDG can be used directly. For example, column outputs C0–C3 are provided directly to the memory multiplexer for addressing the graphics memory as signals XROMD0–XROMD3. The remaining column signals C4–C10 are provided to inputs A0–A6 of ROM 860.

The line output L0 of the video display generator is used directly and applied to the graphics memory as signal YROMD0. Outputs L1–L3 are provided to inputs A5–A7 of ROM device 855. The outputs D0–D2 of device 860 are provided as X address bits XROMD4–XROMD6 to the memory multiplexer. The outputs D3–D7 of device 860 are provided as inputs to address terminals A0–A4 of device 855. The outputs D0–D6 of device 855 are provided as Y addresses YROMD1–YROMD7 to the memory mulitplexer.

Figure 9:
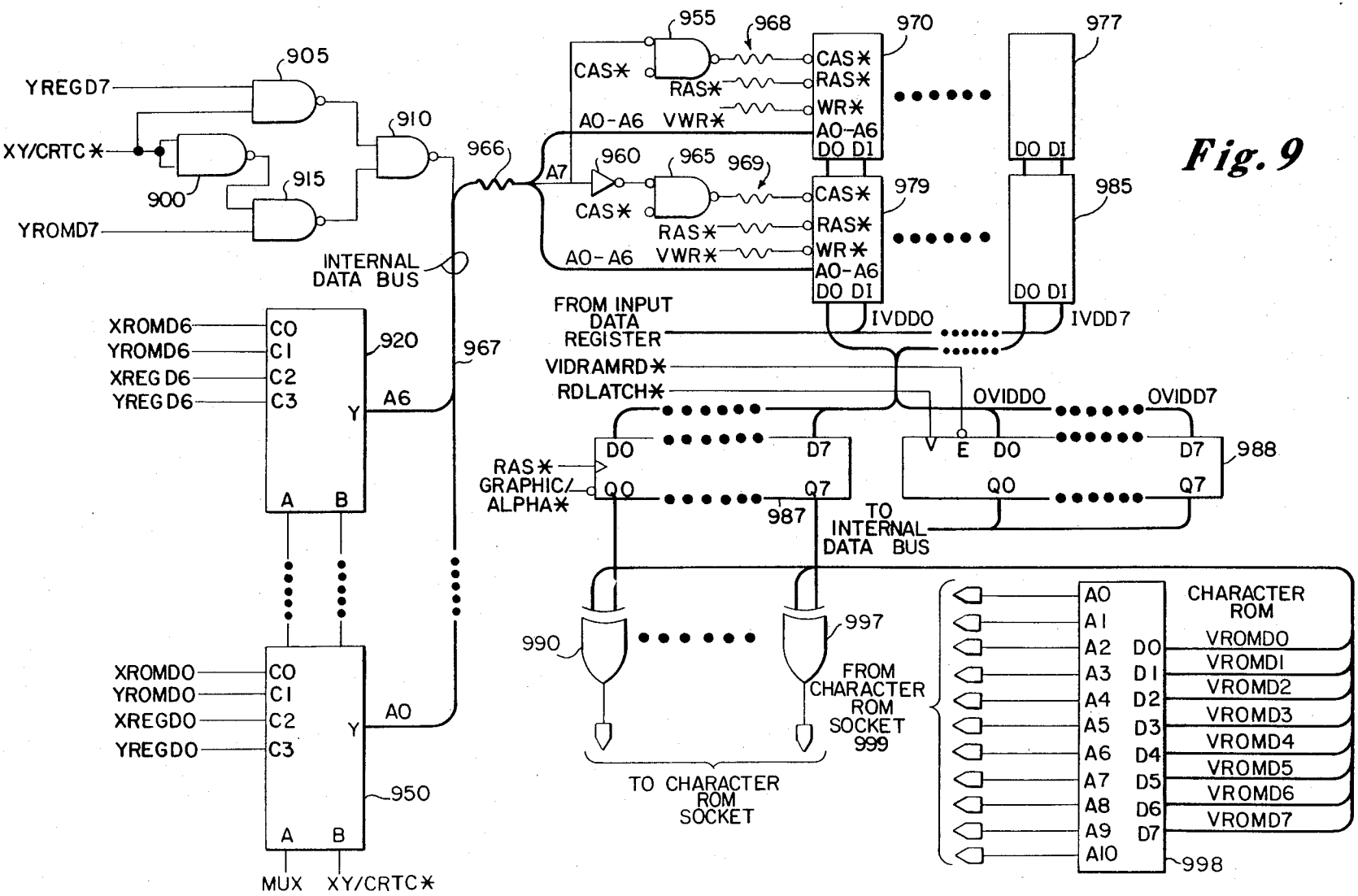
FIG. 9 of the drawings is an electrical schematic of the memory multiplexer graphics memory and data registers.

Detailed circuitry for the graphics memory, memory multiplexer and output data register are shown in FIG. 9. The memory mulitplexer unit consists of multiplexer devices 920 through 950 (only two are shown explicitly for clarity). These devices are well-known digital logic circuits and each device multiplexes information present at one of four inputs, C0–C3, for one address bit of the graphics memory. At any particular time, for each device, one of inputs C0–C3 may be connected to output Y under control of signals appearing on the selection leads A and B. The selected outputs of devices 920–950 are provided to the internal address bus 967 and, through resistors 966, to the graphics memory devices.

The multiplexers are connected for each bit so that the corresponding bit signals produced by the X and Y translating ROMS are applied to the inputs C0 and C1, respectively. Similarly, signals appearing at the output of the X and Y line registers are applied to inputs C2 and C3 for each bit. Selection inputs A of all multiplexers are connected to the MUX lead connected to the memory controller circuitry and selection inputs B are connected to the XY/CRTC* lead connected to the memory controller circuitry. Multiplexers 920–950 operate in a well-known manner under the control of the signals present at the A and B selection inputs so that address information provided by the X and Y translating ROMS is normally provided to the memory (a "low" signal is placed on the XY/CRTC* lead). A "low" signal on the XY/CRTC* lead causes the multiplexer circuitry to connect signals present on either the C0 or the C1 inputs for connection to the output depending on the state of the signal at the A selection input which is connected to the MUX lead. Accordingly, when the signal on the MUX lead is "low", the C0 input is connected to the output and thus X address information is applied to the memory. Similarly, when the MUX signal is "high", Y address information is applied to the memory. In a similar fashion, address information may also be selected from the X and Y line registers when the XY/CRTC* signal becomes "high".

Devices 920–950 process bits D0–D6 of the X and Y addresses. Bit D7 of the Y address is used to directly control the graphics memory. In particular, the graphics memory is arranged in two "banks". Therefore, in the illustrative embodiment, the video screen is split into two "halves" at a designated line. Information to be displayed on the top "half" of the screen is stored in one bank of the graphics memory. Information to be displayed on the lower half of the screen is stored in the other bank of memories. The D7 bit of the Y address is used to select the memory bank which will display the stored information.

The D7 bit of the address information produced by the X Y translation ROMS and by the X Y line registers is provided to gates 900–915. These gates are connected to provide a multiplexing function which is independent of the state of the MUX signal and instead controlled by the signal on the XY/CRTC* lead. A "low" signal on the XY/CRTC* lead allows bank selection to be controlled by the D7 bit of the address information generated by the X Y translator ROMs. A "high" signal on the lead allows bank selection to be controlled by the address information in the X Y line registers.

Specifically, the signal on the XY/CRTC* lead is provided to inverter 900 and applied as a "high" signal to the upper input of NAND gate 915, enabling it. The YROMD7 adddress bit is provided to the lower input of gate 915, and therefore the output of the gate is the inverse of the YROMD7 bit signal. This signal is applied by gate 915 to the A7 lead of the internal data bus 967.

Alternatively, a "high" signal applied to the XY/CRTC* lead causes gate 900 to apply a "low" signal to the upper input of gate 915 disabling it. The "high" signal on the XY/CRTC* is also applied to the lower input of gate 905, enabling it. Thus the output of gate 905 is controlled by the signal on lead YREGD7.

The signals on internal address leads A0–A7 are applied to the graphics random-access memory consisting of memory devices 970–985. Each of devices 970–985 is a well-known random access memory circuit having six memory inputs, A0–A6; a data input, DI and a data output, D0. In addition, each memory is provided with timing and control inputs CAS*, RAS* and WR*. As previously explained, address and data information is entered into the memory under control of signals appearing at the CAS*, RAS* and WR* inputs.

The random access memories are arranged in two banks consisting of devices 970–997 and 978–985. Each device has high impedance outputs and on-chip latches for the outputs so that the outputs can all be connected directly to the corresponding one of leads OVIDD-0–OVIDD7 in the output data bus. As shown on FIG. 8A, all memory inputs are connected to the IVIDD-0–IVIDD7 outputs of the input data register. The address leads of each memory (A0–A6) are are also connected to the corresponding A0–A6 leads of the internal data bus.

Reading and writing of information into and out of the memory is controlled by means of signals on the RAS*, CAS* and VWR* leads. In order to select the appropriate memory bank, the CAS* signal is gated by gates 955–965 under control of the information on the A7 lead of the internal address bus. In particular, a "high" signal applied to the A7 lead of the internal data bus will be inverted by inverter 960 and applied as a "low" signal to enable gate 965. Similarly, the "high" signal on the A7 lead will be applied to gate 955, disabling it. Therefore, the CAS* signal will be applied to the memory bank consisting of memories 978–985, causing a READ or WRITE operation to be performed on this bank.

On the other hand, when the signal on the A7 lead becomes "low", invertor 960 applies a "high" signal to gate 965, thereby disabling it. However, gate 955 is enabled to apply the CAS* signal to the memory bank consisting of memories 971–977.

During a READ operation output data appearing at the D0 outputs of the memory devices in the selected bank is applied to the output data register 988. This register is provided with high impedance outputs and is normally held in a high impedance state. During a read operation (as previously described with respect to FIG. 7) the RDLATCH signal becomes "high" for a short period of time. This "high" signal causes the data outputs signals of the memories to be latched into the output data register. Shortly thereafter the VIDRAMRD* signal becomes low enabling the register outputs. The outputs appear on the internal data bus and from there are provided to the computer data bus to be acted on by the computer.

The outputs of the graphics RAM memories may also be provided to the video screen via holding register 987 and the video shift register associated with the character generator circuitry. The holding register is necessary in certain circuit implementations to provide a delay to ensure that the graphics data is available to the computer at the same time as character information from the character generator. In other implementations the holding register may be eliminated.

Specifically, output data from the graphics memories is latched into the register when the RAS* signal becomes "high". The outputs Q0–Q7 of the register are enabled by a "high" signal appearing on the GRAPHICS/ALPHA* lead. The signal on this lead, as previously described, is produced by the memory controller when the graphics mode option is selected. The outputs are applied to exclusive OR gates 990–997 for transmission via the video shift register associated with the character generation circuitry to the video screen. The other inputs of exclusive OR gates 99–997 are provided with the outputs D0–D7 of the character ROM 990 which has been transplanted from the video generator circuitry. Character ROM 998 receives scanning signals from the character ROM socket on the character generation board via terminals 999, which signals are applied to ROM inputs A0–A10.

Although gates 990–997 are shown as exclusive OR gates other gate combinations may be used depending on the signal polarities and other factors. In the illustrative system, the character information and graphic information are synchronized by the CCLK signal. Since there are separate graphics and video memories, the character and graphics information may be "overlaid" and shown simultaneously on the screen. In this case the use of exclusive OR gates is advantageous since character information overwritten with video information will appear in "reverse" video format and still be visible.

Although one illustrative embodiment of the invention has been shown herein other modifications and circuitry within the spirit and scope of the present invention will become obvious to those skilled in the art.

What is claimed is:

1. Graphics circuitry for use in a computer system including at least one video display unit, and a central processor having means for generating peripheral address signals to select said display unit, and means for generating data signals to be displayed on said unit, said graphics circuitry comprising:

memory means responsive to memory address signals for receiving and storing data, means responsive to selective ones of said peripheral address signals for applying a first plurality of said data signals to said graphics memory as memory address signals, and means responsive to selective ones of said peripheral address signals for entering a second plurality of said data signals into said memory at memory locations specified by said first plurality of data signals as graphics data.

2. Graphics circuitry according to claim 1 wherein said processor includes means responsive to a control signal for temporarily suspending operation and said graphics circuitry further comprises means responsive to selected ones of said peripheral address signals for generating said control signal.

3. Graphics circuitry according to claim 1 wherein said processor includes means for generating a write signal and wherein said entering means comprises means responsive to said write signal for receiving and storing said data signals, and means for controlling said memory means to enter said stored data signals into said memory means, said controlling means starting operation in response to selective ones of said peripheral address signals and thereafter operating independently from said processor.

4. Graphics circuitry according to claim 1 wherein said applying means comprises, means responsive to selective ones of said peripheral address signals for receiving and storing said data signals, means responsive to selective ones of said peripheral address signals for incrementing and decrementing said stored data signals, and means responsive to stored data signals for applying said stored signals as memory address signals to said memory means.

5. Graphics circuitry according to claim 4 wherein said storing means comprises a bi-directional counter.

6. Graphics circuitry for use in a computer system including at least one video screen display unit, and a central processor having means to generate data signals and control signals, said graphics circuitry comprising, memory means having a plurality of memory locations, said memory means being responsive to row and column memory address signals for accessing one of said memory locations which contains information to be displayed on said screen at a physical location specified by said row and column addresses, and means responsive to a plurality of said data signals for repetitively converting selected ones of said data signals into row and column address signals for application to said memory means as a plurality of row and column address signals.

7. Graphics circuitry according to claim 6 wherein said video screen display unit includes character generation circuitry for displaying alpha and numeric characters, said character generation circuitry generating line and column position signals specifying the position of the screen at which information is to be displayed and synchronization signals, and said graphics circuitry further comprises means responsive to said line and column position signals for generating row and column memory address signals, and means responsive to selected ones of said control signals for applying row and column memory address signals produced by said generating means to said memory means to cause a sequential display of information in each of said memory locations and responsive to selected ones of said control signals for applying said memory row and column address signals produced by said converting means to said memory means for causing display of information at a single location on said screen.

8. Graphics circuitry according to claim 7 wherein said applying means comprises a multiplexer having inputs for receiving memory address signals produced by said generating means and inputs for receiving memory address inputs generated by said converting means and an output connected to address port of said memory means, and said applying means further comprises means responsive to selected ones of said control signals for connecting selected multiplexer inputs to said multiplexer output.

9. Graphics circuitry for use in a computer system including at least one video screen display unit, and a central processor having means for generating peripheral address signals to select said display unit, and means for generating data signals to be displayed on said unit, said graphics circuitry comprising, memory means having a plurality of memory locations, said memory means being responsive to row and column memory address signals for accessing one of said memory locations which contains information to be displayed on said screen at a physical location specified by said row and column addresses, and means responsive to selective ones of said peripheral address signals for converting selective ones of said data signals into row and column address signals for application to said memory means, and means responsive to selective ones of said peripheral address signals for entering selective ones of said data signals into said memory as graphics data.

10. Graphics circuitry according to claim 9 wherein said video screen display unit includes character generation circuitry for displaying alpha and numeric characters, said character generation circuitry generating line and column position signals specifying the position of the screen at which information is to be displayed and synchronization signals, and said graphics circuitry further comprises, means responsive to said line and column position signals for generating row and column memory address signals, and means responsive to selected ones of said peripheral address signals for applying row and column memory address signals produced by said generating means to said memory means to cause a sequential display of information in each of said memory locations and responsive to selected ones of said peripheral address signals for applying said memory row and column address signals generated by said converting means to said memory means for causing display of information at a single location on said screen.

11. Graphics circuitry according to claim 10 wherein said applying means comprises, means responsive to selective ones of said peripheral address signals for receiving and storing said data signals, means responsive to selective ones of said peripheral address signals for incrementing and decrementing said stored data signals, and means responsive to stored data signals for applying said stored signals as memory address signals to said memory means.

12. Graphics circuitry according to claim 11 wherein said applying means further comprises a multiplexer having inputs for receiving memory address signals produced by said generating means and inputs for receiving memory address inputs stored in said storing means and an output connected to address port of said memory means, and said applying means further comprises means responsive to selected ones of said peripheral address signals for connecting selected multiplexer inputs to said multiplexer output.

13. Graphics circuitry according to claim 12 wherein said processor includes means for generating a write signal and wherein said entering means comprises means responsive to said write signal for receiving and storing said data signals, and means for controlling said memory means to enter said stored data signals into said memory means, said controlling means starting operation in response to selective ones of said peripheral address signals and thereafter operating independently from said processor under control of said synchronization signals generated by said character generation circuitry.

14. Graphics circuitry according to claim 13 wherein said storing means comprises a bi-directional counter for storing row address signals and a bi-directional counter for storing column address signals.

15. Graphics circuitry for use in a computer system including at least one video screen display unit, said unit including character generation circuitry for displaying alpha and numeric characters, said character generation circuitry generating line and column position signals specifying the position of the screen at which information is to be displayed and synchronization signals, and a central processor having means for generating peripheral address signals to select said display unit, and means for generating data signals to be displayed on said unit, said graphics circuitry comprising, a random access memory having a plurality of memory locations, said memory being responsive to row and column memory address signals for accessing one of said memory locations which contains information to be displayed on said screen at a physical location specified by said row and column addresses, a command decoder responsive to selected ones of said peripheral address signals for generating a plurality of memory control signals, two bi-directional counters responsive to selective ones of said memory control signals for receiving and storing selected ones of said data signals, means responsive to selective ones of said memory control signals for selectively incrementing and decrementing said counters, read-only memory means responsive to said line and column position signals for generating row and column memory address signals, a multiplexer having inputs for receiving memory address signals produced by said read-only memory means and inputs for receiving data signals stored in said counters and an output connected to address port of said random access memory, and means responsive to selected ones of said memory control signals for connecting selected multiplexer inputs to said multiplexer output.

16. Graphics circuitry according to claim 15 wherein said processor includes means for generating a write signal and means responsive to a control signal for temporarily suspending operation and wherein said command decoder comprises, means responsive to selected ones of said peripheral address signals and to said write signal for generating said control signal, and means for controlling said random access memory to enter data signals into said random access memory, said controlling means starting operation in response to selective ones of said peripheral address signals and thereafter operating independently from said processor under control of said synchronization signals generated by said character generation circuitry.

17. Graphics circuitry according to claim 16 wherein said random access memory is a dynamic random access memory.

18. Graphics circuitry for use in a computer system including at least one video screen display unit having means to generate video address signals on a video address bus, and a central processor having means to generate data signals on a data bus, address signals on an address bus and control signals on a control bus, said graphics circuitry comprising, a graphics memory having a plurality of memory locations, and an address port, said memory being responsive to address signals at said address port for accessing one of said memory locations, and multiplexer means for selectively applying signals on said data bus and said video address bus to said memory address port as address signals.

19. Graphics circuitry according to claim 18 wherein said multiplexer means is responsive to signals on said address bus for applying signals on said video address bus and said data bus to said memory address port.

20. Graphics circuitry according to claim 18 wherein said processor includes means responsive to a control signal for temporarily suspending operation and said graphics circuitry further comprises means responsive to selected ones of said address signals on said address bus for generating said control signal.

21. Graphics circuitry according to claim 18 wherein said processor includes means for generating a write signal and wherein said graphics circuitry further comprises means responsive to said write signal for receiving and storing data signals on said data bus, and means for controlling said graphics memory to enter said stored data signals into said graphics memory, said controlling means starting operation in response to selective ones of said address signals on said address bus and thereafter operating independently from said processor.

22. Graphics circuitry according to claim 18 further comprising, means responsive to selective ones of said address signals on said address bus for receiving and storing data signals on said data bus, means responsive to selective ones of said address signals on said address bus for incrementing and decrementing said stored data signals, and means responsive to stored data signals for applying said stored signals as memory address signals to said memory means.

23. Graphics circuitry according to claim 22 wherein said receiving and storing means comprises a bi-directional counter.

* * * * *